US010821050B2

(12) United States Patent
Rubin

(10) Patent No.: US 10,821,050 B2
(45) Date of Patent: Nov. 3, 2020

(54) APPARATUS FOR AUTOMATICALLY DELIVERING COMPRESSIONS TO THE CHEST

(71) Applicant: HEARTSAVR TECHNOLOGIES, INC., Montclair, NJ (US)

(72) Inventor: Richard Howard Rubin, Fairfield, NJ (US)

(73) Assignee: HEARTSAVR TECHNOLOGIES, INC., Montclair, NJ (US)

( * ) Notice: Subject to any disclaimer, the term of this patent is extended or adjusted under 35 U.S.C. 154(b) by 788 days.

(21) Appl. No.: 15/402,592

(22) Filed: Jan. 10, 2017

(65) Prior Publication Data

US 2017/0209336 A1 Jul. 27, 2017

Related U.S. Application Data

(60) Provisional application No. 62/276,899, filed on Jan. 10, 2016.

(51) Int. Cl.
*A61H 31/00* (2006.01)

(52) U.S. Cl.
CPC ... *A61H 31/006* (2013.01); *A61H 2201/0165* (2013.01); *A61H 2201/12* (2013.01); *A61H 2201/1215* (2013.01); *A61H 2201/1418* (2013.01); *A61H 2201/1664* (2013.01); *A61H 2201/50* (2013.01); *A61H 2201/5038* (2013.01); *A61H 2201/5046* (2013.01)

(58) Field of Classification Search
CPC ..... A61H 31/00; A61H 31/004; A61H 31/006–007; A61H 2031/001–002; A61H 2201/12; A61H 2201/5046; A61H 2201/5038; A61H 2201/50; A61H 2201/1215; A61H 2201/0165; A61H 2201/1418; A61H 2201/1664
See application file for complete search history.

(56) References Cited

U.S. PATENT DOCUMENTS 3,264,044 A * 8/1966 Davenport ..... F16C 23/06 384/619
3,489,140 A * 1/1970 Mullikin ..... A61H 31/006 601/97
3,512,522 A * 5/1970 Greenlee ..... A61H 31/006 601/106
3,627,088 A * 12/1971 Muller ..... A61H 31/006 192/142 R (Continued)

OTHER PUBLICATIONS

Vinod S Achary, "Scotch Yoke Mechanism *Most Viewed Scotch Yoke animation on youtube", Oct. 9, 2008, retrieved from https://www.youtube.com/watch?v=hsaoTo1vuY4 (Year: 2008).*

*Primary Examiner* — Quang D Thanh
*Assistant Examiner* — Jacqueline M Pinderski
(74) *Attorney, Agent, or Firm* — Oliff PLC

(57) ABSTRACT

The apparatus is configured for applying chest compressions to a patient to apply CPR. The apparatus includes a housing configured to mount the apparatus to the patient, a unidirectional motor, and a plunger connected to the unidirectional motor, the plunger configured to apply the chest compressions to the patient when the motor is operated. The apparatus may include a device configured to control a compression distance of compressions. The apparatus is simpler, lighter and eliminates complicated motor control required in prior devices.

8 Claims, 4 Drawing Sheets

(56) References Cited

U.S. PATENT DOCUMENTS

| | | | | |
|---|---|---|---|---|
| 4,059,099 | A * | 11/1977 | Davis | A61H 31/00 601/41 |
| 4,428,248 | A * | 1/1984 | Broucksou | F16H 61/32 192/109 A |
| 5,496,257 | A * | 3/1996 | Kelly | A61H 31/005 600/454 |
| 8,690,804 | B2 | 4/2014 | Nilsson et al. | |
| 10,004,662 | B2 * | 6/2018 | Jeppsson | A61H 31/006 |
| 2010/0185127 | A1 * | 7/2010 | Nilsson | A61H 31/004 601/41 |

* cited by examiner

APPARATUS FOR AUTOMATICALLY DELIVERING COMPRESSIONS TO THE CHEST

CROSS-REFERENCE TO RELATED APPLICATION

This nonprovisional application claims the benefit of U.S. Provisional Application No. 62/276,899, filed Jan. 10, 2016, the disclosure of which is incorporated herein by reference.

BACKGROUND

Cardiopulmonary Resuscitation (CPR) is typically delivered to someone that has had their heart stop. Compressing the heart through the chest cavity has been proven to keep the blood pumping and oxygen flowing to the brain until the heart starts pumping again on its own. This is usually the first step to trying to revive someone that has stopped breathing. These compressions today are typically performed by an EMT, hospital personnel or someone standing by while it has happened to someone else.

CPR is given by someone kneeling next to a person and leaning over them with their two hands on top of each other pushing down on the person's chest in a precise location. Each push down on the person's chest must be 2" in depth and at a rate of 100 times per minute. This takes a force of over 120 lbs to accomplish this depth each time. Compressions can last up to 45 minutes before you should stop before the person can no longer be revived.

Sustaining this rate and force over 45 minutes is practically impossible. Therefore a mechanical device is needed to increase the rate of survival.

Apparatus for administering CPR are known, but these devices have used compressed air pneumatics or reversible motors. The compressed air devices require a supply of compressed air, which may not be available in a location where the CPR is to be administered. The devices with reversible motors require additional control elements, such as a stepper motor or a servo motor due to hysteresis or torque ripple that may be produced.

SUMMARY

The apparatus is configured for applying chest compressions to a patient to apply CPR. The apparatus includes a housing configured to mount the apparatus to the patient, a unidirectional motor, and a plunger connected to the unidirectional motor, the plunger configured to apply the chest compressions to the patient when the motor is operated. The apparatus may include a device configured to control a compression distance of compressions.

DETAILED DESCRIPTION OF EMBODIMENTS

Figure 1:
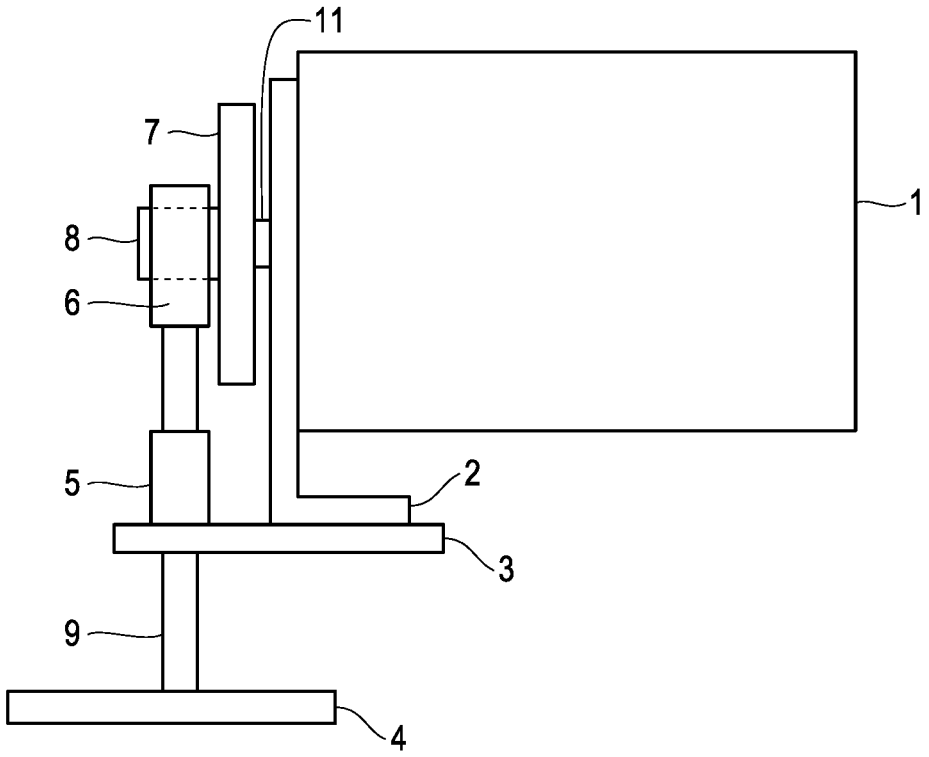
FIG. 1 is a side view of the mechanical portion of the apparatus, depicting a motor turning a cam wheel which moves the piston up and down thru bearings.
Figure 2:
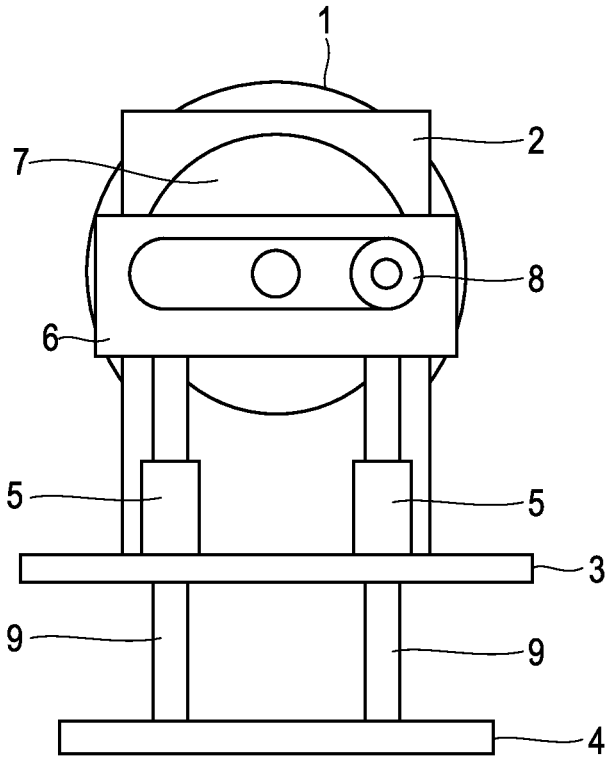
FIG. 2 is a front view of the mechanical portion of the apparatus with the bearing in the cam block with two slide rods and bearings for stability.
Figure 3:
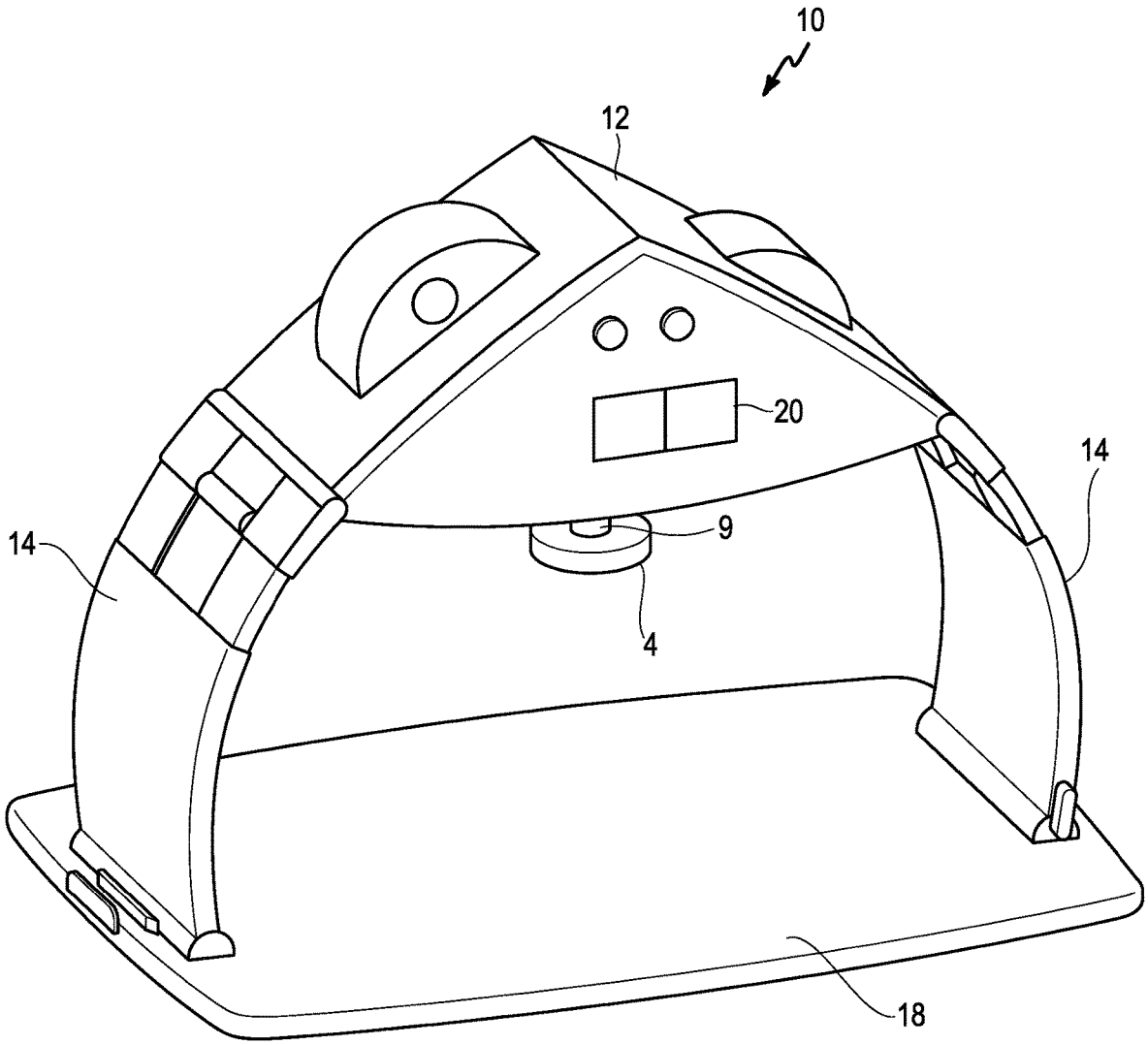
FIG. 3 is a perspective view of the apparatus.

The apparatus 10 for applying CPR includes a device for applying chest compressions, and is illustrated in FIGS. 1-3.

The apparatus 10 includes a motor 1 configured to drive a plunger 4 in upward and downward directions to apply the chest compressions to a person. The person will be laying down on their back, with the plunger in its upward position is disposed over the chest of the person.

As shown in FIG. 1, the motor 1 is mounted to a motor bracket 2, which is mounted to a base plate 3. A motor shaft 11 is attached to a cam wheel 7. A bearing 8 attached to the cam wheel 7 projects out at a certain distance from a center of the motor shaft 11. This distance from the center of the motor shaft 10 coupled with the size of the bearing 8 determine an up and down stroke of the cam block 6. Both, the distance from the center of the motor shaft 11 and the bearing 8 are sized to create an up and down stroke of the plunger 4 of 2 inches. The exact size of the bearing 8 and the distance from the center of the motor shaft 10 can be varied, as long as they are sized to move the cam block 6 and the plunger up and down 2 inches. The distance of compressions may be varied, such as to 1.75 inches when used with a child.

Another variation of the motor 1 mounting may have it coupled to a shaft by gears, pulleys or belts. This would allow the motor 1 to be offset from the center of the device where the plunger 4 is located on the person. The cam wheel 7 will be mounted on a shaft with a gear, pulley, belt or any combination thereof, attached and connected to the motor 1 which is offset and has a gear, pulley, belt or any combination thereof, connected to its shaft as well.

As the motor shaft 11 rotates, the cam wheel 7 rotates and the bearing 8 which is attached to the cam wheel 7 and inserted into the cam block 6, moves back and forth within slot 13, and drives the cam block 6 up and down 2 inches every complete rotation of the motor shaft 11. The cam block 6 is connected to at least one piston or slide rod 9 which moves up and down with the cam block 6. Two slide rods 9 are shown here to give more stability to the up and down motion. The slide rods 9 move thru at least one bearing 5 which is mounted to the base plate 3. Multiple bearings 5 may be used for more stability. Two slide rods 9 are shown here. The slide rods 9 that project from the cam block 6 are connected at their distal end to the plunger 4. The plunger 4 is configured to be positioned directly on top of the chest of a person, and compresses the chest of the person 2 inches every 180 degree rotation of the motor 1 with downward movement of the plunger 4. When the motor 1 continues to complete one full rotation, the chest is allowed to decompress back to a normal state with upward movement of the plunger.

As illustrated in FIG. 3, the apparatus 10 includes a housing 12, having the motor 1 and associated elements disposed therein. A bottom portion of slide rod 9 and the plunger 4 may extend outward from the housing 12. The housing 12 includes side panels 14, which may or may not be detachable, and a user interface 20. The user interface 20 could be a touch screen element, such as a touch screen LCD. The user interface may be used to control the apparatus 10, such as starting and stopping of the motor, setting adjustable controls such as the up/down distance of the plunger 4, etc. The user interface may be connected to a processor and memory (not shown), which may be programmed to control the apparatus.

The plunger may be of a round shape, a square or rectangular shape, or any other shape. A pad may be included on the bottom surface of the plunger 4.

The base plate 3 may be connected to the two side panels 14, one at each end, which are connected to a backboard 18. In use, the backboard 18 is positioned under the person receiving the chest compressions. The apparatus 10 may include side panels 14 and backboard 18 that are adjustable to fit the various sizes of the human body.

The motor 1 is driven by a motor controller such as the above mentioned processor or another controller device, which is controlled by a user interface 20. The user interface may receive input from the person attaching the device to the person is to receive the chest compressions.

To use the apparatus 10, the person administering the CPR, would place the backboard 18 under the person needing CPR and attach the side panels 14 which are connected to the apparatus 10 to each side of the backboard 18 under the person's armpits. The apparatus 10 is placed such that the plunger 4 touches the person's chest and is locked in place. The motor 1 is started and stopped by operation of the user interface 20 to administer the chest compressions.

The motor 10 is a unidirectional motor that turns in only one direction. Use of the unidirectional motor avoids the torque ripple or hysteresis that may be experienced when using a two direction motor. Additionally, the overall device is simplified by not needing any servomotor or stepper motor for electronic control. The torque, power and speed of the motor 10 are selected, along with the power of the battery, to provide the plunger with 120 lbs. of force at 100 times per minute, to provide the compressions with the needed power and speed.

The motor 10 may be driven by a battery and strokes 100 times per minute at a depth of 2" or 1¾" into the chest of a person. By using a unidirectional motor that continually turns in one direction to create the motion of the piston up and down, the electronics and the mechanism are simplified while increasing the life of the motor 10. Other devices that do not use unidirectional motors have to stop and reverse the motor to move their piston up and down. This apparatus is much more precise as it can only move a fixed distance, therefore eliminating any electronic error that could happen with other devices. The change from 2" to 1¾" is done by a spring loaded plunger which when unlocked will allow the plunger to compress ¼", therefore only allowing a compression of the chest of 1¾". When locked the compression will be 2". Locking the plunger can be done by rotation, fasteners or any other means to stop it from compressing. The compression can be done by springs, compressible material or mechanically.

Figure 4A:
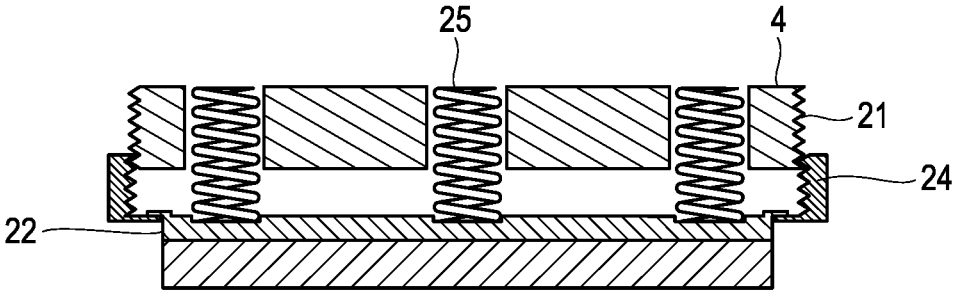
FIGS. 4*a* and 4*b* cross-sectional and bottom views of the plunger 4.
Figure 4B:
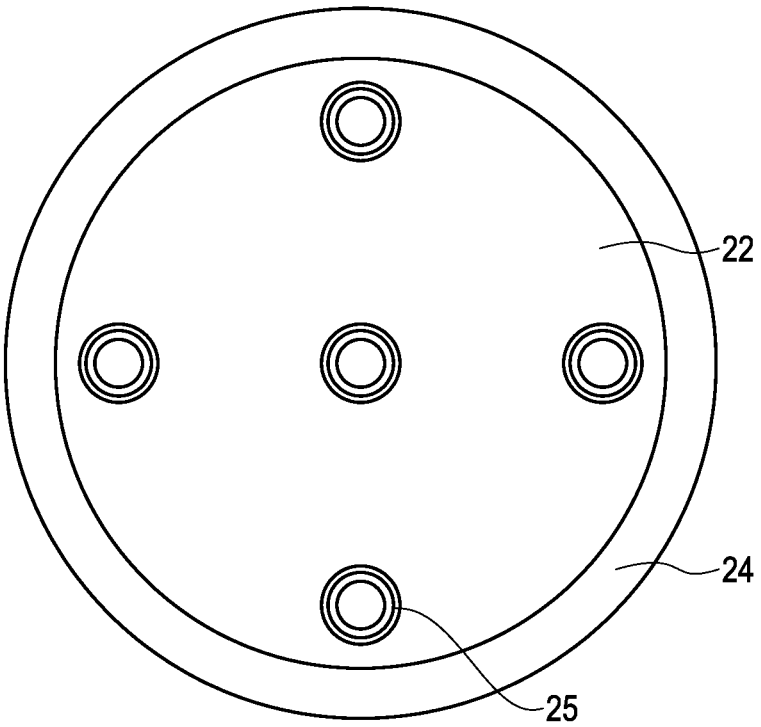

As illustrated in FIG. 4*a*, the plunger 4 may have threads 21 on the outside and house 5 springs 25. The ring 24 threads onto the plunger 4 with holes in it to allow the springs 25 to pass thru. The platen 22 is captured by the ring 24 and has receptacles for the other end of the springs 25. When extended as shown, the platen 22 can be compressed towards the plunger 4 by ¼ inch when forced against the body, pushing thru the ring 24. When the ring 24 is threaded all the way onto the plunger 4, the platen 22 is drawn in ¼" to the plunger 4 and can no longer compress against the plunger 4.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein; as well as in the claims which follow, they are used only in a generic and descriptive sense, and not for the purposes of limiting the present disclosure, nor the claims which follow.

What is claimed is:

1. An apparatus for applying chest compressions to a patient, comprising:

a housing configured to mount the apparatus to the patient;

a unidirectional motor;

a plunger connected to the unidirectional motor, the plunger configured to apply the chest compressions to the patient when the unidirectional motor is operated; and a device configured to control a distance of the chest compressions applied by the apparatus for applying chest compressions, comprising:

a ring configured to thread onto a threaded outer portion of the plunger, a platen attached to the ring, and a plurality of springs passing through holes in the plunger and connected to the platen, wherein, when the ring is partially threaded onto the threaded outer portion of the plunger, the platen is configured to move in a direction towards the plunger when compressed against a chest of the patient.

2. The apparatus according to claim 1, further comprising a shaft connected to the unidirectional motor that is configured to rotate when the unidirectional motor is operated, and an assembly configured to convert a rotation of the shaft into an up and down motion of the plunger to apply the chest compressions to the patient.

3. The apparatus according to claim 2, wherein the assembly comprises:

a cam wheel connected to the shaft, the cam wheel having a bearing protruding therefrom;

a cam block having a slot formed therein, the bearing being disposed within the slot; and at least one slide rod having a first end connected to the cam block and a second end connected to the plunger;

wherein the bearing is configured to move back and forth within the slot when the shaft rotates, causing the cam block and the plunger attached thereto to move in an up and down direction.

4. The apparatus according to claim 3, further comprising a user interface for controlling the apparatus for applying chest compressions to the patient.

5. The apparatus according to claim 1, wherein the device configured to control the distance of compressions has a dimension extending in a compression direction that is adjustable between a first dimension when the ring is partially threaded onto the threaded outer portion of the plunger, and a second dimension when the ring is completely threaded onto the threaded outer portion of the plunger.

6. The apparatus according to claim 1, wherein a torque, a power and a speed of the unidirectional motor provide the plunger with 120 lbs. of force at 100 times per minute.

7. An apparatus for applying chest compressions to a patient, comprising:

a housing configured to mount the apparatus to the patient;

a unidirectional motor; and a plunger connected to the unidirectional motor, the plunger configured to apply the chest compressions to the patient when the unidirectional motor is operated, the plunger including a device configured to control a compression distance of the chest compressions applied by the plunger.

8. The apparatus according to claim 7, wherein a torque, a power and a speed of the unidirectional motor provide the plunger with 120 lbs. of force at 100 times per minute.

* * * * *